US011047542B2

(12) United States Patent
Zhang et al.

(10) Patent No.: US 11,047,542 B2
(45) Date of Patent: Jun. 29, 2021

(54) LIGHT DISTRIBUTION MEMBER, LIGHTING OR SIGNALING DEVICE AND MOTOR VEHICLE

(71) Applicant: VALEO VISION, Bobigny (FR)

(72) Inventors: Piao Zhang, Wuhan (CN); Qiang Hu, Wuhan (CN)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/256,484

(22) PCT Filed: Jun. 24, 2019

(86) PCT No.: PCT/CN2019/092610
§ 371 (c)(1),
(2) Date: Dec. 28, 2020

(87) PCT Pub. No.: WO2020/001413
PCT Pub. Date: Jan. 2, 2020

(65) Prior Publication Data

US 2021/0131634 A1 May 6, 2021

(30) Foreign Application Priority Data

Jun. 29, 2018 (CN) ..... 201810715681.8

(51) Int. Cl.
*F21V 7/06* (2006.01)
*F21S 41/32* (2018.01)
(Continued)

(52) U.S. Cl.
CPC ..... *F21S 41/321* (2018.01); *F21S 41/25* (2018.01); *F21S 41/336* (2018.01); *F21S 41/36* (2018.01);
(Continued)

(58) Field of Classification Search
None
See application file for complete search history.

(56) References Cited

U.S. PATENT DOCUMENTS 10,330,274 B2 6/2019 Chen et al.
2007/0177400 A1 8/2007 Tatsukawa
(Continued)

FOREIGN PATENT DOCUMENTS

CN 103123078 A 5/2013
CN 106979503 A 7/2017
(Continued)

OTHER PUBLICATIONS

International Search Report dated Sep. 25, 2019 in PCT/CN2019/092610 filed Jun. 24, 2019.

*Primary Examiner* — Elmito Breval
(74) *Attorney, Agent, or Firm* — Oblon, McClelland, Maier & Neustadt, L.L.P.

(57) ABSTRACT

Provided are a light distribution member, a lighting or signaling device having the same, and a motor vehicle. A main body part of the light distribution member defines: a light incidence surface, through which light from a light source enters the main body part; a light emergence surface, a portion of the light entering the main body part being allowed to reach the light emergence surface directly in such a way that the portion of the light acts as a first light beam that is at least substantially parallel; and a first side surface and a second side surface, which are reflective faces and arranged on either side of an axis (O-O'), wherein at least one of the first side surface and the second side surface is provided with at least one first reflective structure configured to reflect the light reaching it, and to direct the reflected light as a second light beam toward the light emergence surface, and wherein an angle of the first light beam relative to the
(Continued)

axis (O-O') is different from an angle of the second light beam relative to the axis (O-O').

20 Claims, 6 Drawing Sheets

(51) Int. Cl.

| | |
|---|---|
| ***F21S 41/36*** | (2018.01) |
| ***F21S 41/25*** | (2018.01) |
| ***F21S 43/31*** | (2018.01) |
| ***F21S 41/33*** | (2018.01) |
| ***F21S 43/20*** | (2018.01) |
| *F21W 103/20* | (2018.01) |

(52) U.S. Cl.
CPC ..... *F21S 43/26* (2018.01); *F21S 43/31* (2018.01); *F21W 2103/20* (2018.01)

(56) References Cited

U.S. PATENT DOCUMENTS

| | | | | |
|---|---|---|---|---|
| 2008/0043466 | A1* | 2/2008 | Chakmakjian ..... | G02B 19/0066 362/237 |
| 2016/0265745 | A1* | 9/2016 | Huang ..... | G02B 19/0061 |
| 2018/0142855 | A1 | 5/2018 | Chen et al. | |

FOREIGN PATENT DOCUMENTS

| | | | |
|---|---|---|---|
| CN | 107448781 | A | 12/2017 |
| CN | 208901313 | U | 5/2019 |
| EP | 3 260 764 | A1 | 12/2017 |
| EP | 3 327 337 | A1 | 5/2018 |

* cited by examiner

LIGHT DISTRIBUTION MEMBER, LIGHTING OR SIGNALING DEVICE AND MOTOR VEHICLE

FIELD OF THE DISCLOSURE

Embodiments of the present disclosure relate to a lighting and/or signaling field, and more specifically to a light distribution member, and a lighting or signaling device having the light distribution member and a motor vehicle.

DESCRIPTION OF THE RELATED ART

A variety of lighting and/or signaling devices are used to provide light for lighting and/or signaling, and are widely used in various fields, for example, a lighting device or a signaling device such as a vehicle lamp is provided in a motor vehicle to ensure safe driving.

Typically, an optical element is used to modulate light exiting from a light source and entering the optical element via a light incidence surface or a light inlet of the optical element, so as to form emergent light with a desired light distribution or pattern, and to guide or emit, at a light emergence surface of the optical element, the emergent light toward a target direction to achieve a lighting or signaling function. In order to achieve a wide emergent light or illumination range and improve optical efficiency, the optical element may be provided with a plurality of light incidence surfaces or light inlets. However, this will increase the number of light sources, resulting in increased costs. Currently, when the size of the optical element's light emergence surface (for example, the emergent light width) is larger, for example greater than 60 mm, and when the optical element is only provided with one light incidence surface or light inlet, it is difficult to achieve a balance between the optical efficiency or the emergent light or illumination range and the regulatory requirements, especially in the case of the optical element being used as a turn signal lamp, a position lamp or the like in a motor vehicle.

For these lighting or signaling devices, such as motor vehicle's turn signal lamp, position lamp, etc., they are required to not only implement normal lighting or signaling functions, such as turning indication, position indication, etc., but also achieve external visibility of a certain angle range to ensure that the nearby traffic participants can see the vehicle within a certain angle range (for example, at a side position) so as to improve driving safety.

SUMMARY

Therefore, an object of the present disclosure is to overcome at least one of problems and drawbacks in the prior art.

According to an aspect of the present disclosure, it provides a light distribution member for a motor vehicle, the light distribution member having an axis and comprising a main body part, the main body part defining: a light incidence surface, through which light from a light source enters the main body part; a light emergence surface, a portion of the light entering the main body part being allowed to reach the light emergence surface directly in such a way that the portion of the light acts as a first light beam that is at least substantially parallel; a first side surface and a second side surface, the first side surface and second side surface being reflective faces and arranged on either side of the axis, wherein at least one of the first side surface and the second side surface is provided with at least one first reflective structure configured to reflect the light reaching it, and to direct the reflected light as a second light beam toward the light emergence surface, and wherein an angle of the first light beam relative to the axis is different from an angle of the second light beam relative to the axis. Here, both the lighting effect and the regulatory requirements for the emergence angle could be met by causing at least two different light beams having different angles relative to the axis to reach the light emergence surface, for example, the regulatory requirement of 25 degrees and 80 degrees for the emergence angle is met, thereby the light distribution member can be used as a position lamp or a turn signal lamp.

In some embodiments, at least one of the first side surface and the second side surface is further provided with at least one second reflective structure configured to reflect the light reaching it in such a way that the reflected light is at least substantially parallel to the first light beam. Thereby, the light emergence size of the light emergence surface may be further enlarged.

In some embodiments, a plurality of said first reflective structures are provided and distributed on at least one of the first side surface and the second side surface, and are tilted at corresponding angles relative to the axis.

In some embodiments, the at least one of said first reflective structures is tilted toward the axis in a light emergence direction.

In some embodiments, a plurality of said second reflective structures are provided and arranged adjacently or spaced apart on corresponding side surfaces, and each of the second reflective structures is a part of a paraboloid having a focus point where the light source is located. With this arrangement, the light reaching the second reflective structures can be reflected at least to a large extent into a parallel light beam, preferably be reflected in parallel to the first light beam.

In some embodiments, the light distribution member has a single light incidence surface.

In some embodiments, the light incidence surface comprises a first light incidence sub-surface and second light incidence sub-surfaces located on either side of the first light incidence sub-surface, the light emergence surface comprises a first light emergence sub-region and second light emergence sub-regions located on either side of the first light emergence sub-region, the first light incidence sub-surface is configured to collimate the light entering the main body part through the first light incidence sub-surface into a parallel light such that the parallel light travels in the main body part, parallelly to the axis, to the first light emergence sub-region and exits from the first light emergence sub-region, and each of the second light incidence sub-surfaces is configured to cause light, which is transmitted through the second light incidence sub-surface into the main body part, to travel in the main body part to a corresponding side surface of the first side surface and the second side surface and to be reflected in the main body part toward the light emergence surface at the corresponding side surface.

In some embodiments, wherein the first light incidence sub-surface is provided with a plurality of dome shaped or pillow shaped protrusions configured to cooperate with each other to collimate the light, which enters the main body part through the protrusions, into the parallel light.

In some embodiments, at least one of the second light incidence sub-surfaces is an arched surface, which is configured to collimate light in a thickness direction of the light distribution member.

In some embodiments, an edge profile of the at least one of the second light incidence sub-surfaces in the thickness direction of the light distribution member is a part of a circular arc line having a center where the light source is located.

In some embodiments, the light incidence surface is a cylindrical Fresnel lens structure centered at the light source, so as to collimate the incidence light in the thickness direction of the light distribution member.

In some embodiments, the main body part is formed therein with a linear Fresnel lens structure so as to collimate the light entering the main body part into a parallel light beam.

According to another aspect of the present disclosure, it further provides a lighting or signaling device, comprising a light source and the light distribution member described in any one of embodiments of the present disclosure.

In some embodiments, the lighting or signaling device comprises one of a turn signal lamp or a position lamp of a motor vehicle.

According to a further aspect of the present disclosure, it also provides a motor vehicle, comprising the lighting or signaling device described in any one of embodiments of the present disclosure.

In embodiments of the present disclosure, in particular in the case where only one light incidence surface is provided, by providing a first reflective structure on the corresponding side surface of the light distribution member, in combination with other optical functional surfaces, it is still possible to achieve desired light emergence effect for a long light emergence surface, and the optical distribution also meets the regulatory requirements. Here, the light distribution member itself is relatively simple in structure, which further facilitates installation and reduces costs.

The other purposes and advantages of the present disclosure will be apparent from the detailed description of the present disclosure made below with reference to the accompanying drawings, and this description and these accompanying drawings may provide a comprehensive understanding of the present disclosure.

BRIEF DESCRIPTION OF THE DRAWINGS

These and/or other aspects, features and advantages of the present disclosure will become apparent and easy to be understood from the following description of the explanatory embodiments made in conjunction with the accompanying drawings, where.

DETAILED DESCRIPTION OF THE EMBODIMENTS

Figure 1:
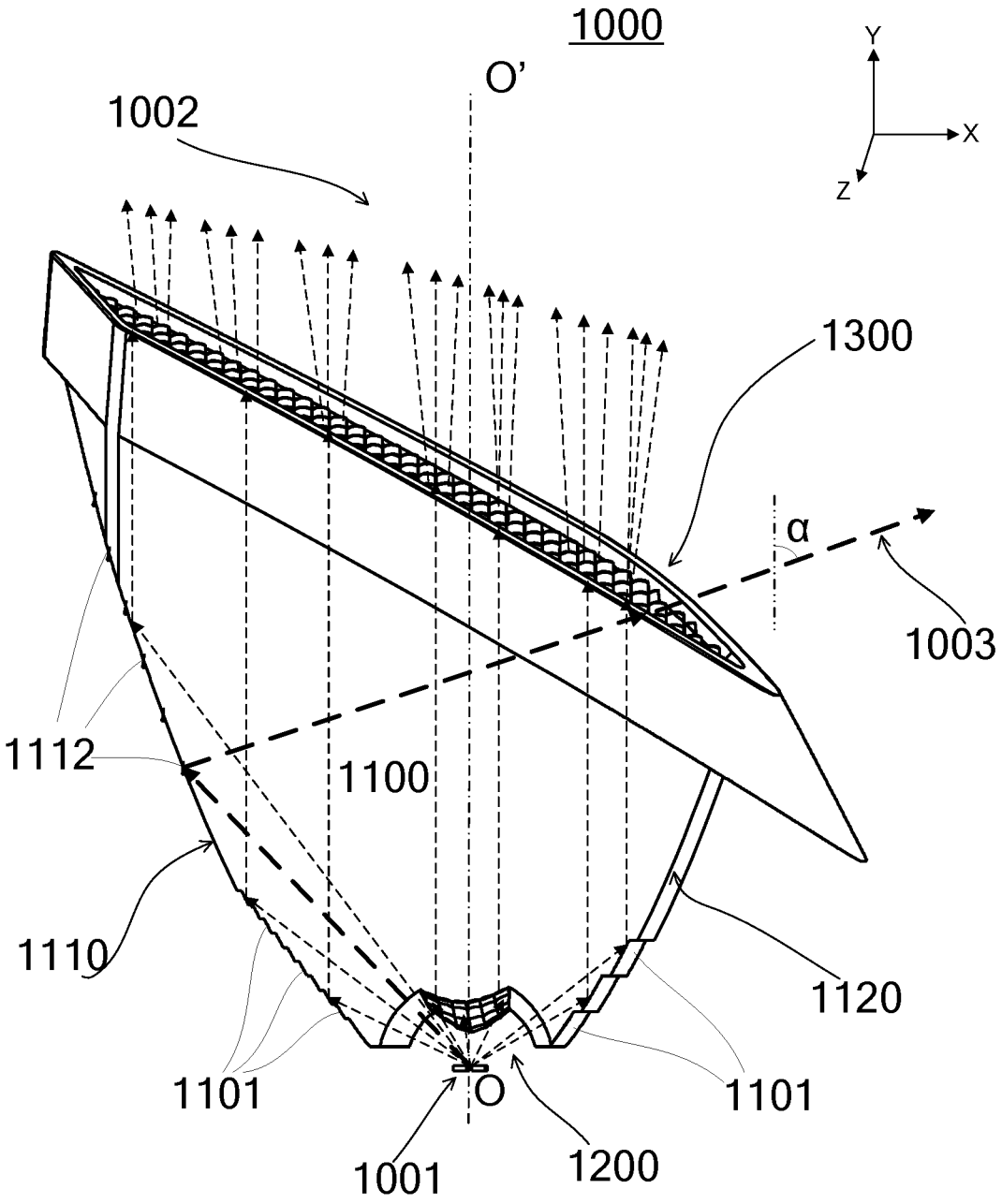
FIG. 1 is a perspective view showing a structure of a light distribution member according to an exemplary embodiment of the present disclosure, in which normal light emergence and light paths for external visibility are schematically shown.

The embodiments of the present disclosure will be described in detail below in conjunction with the drawings. The same or similar reference numerals refer to the same or similar elements throughout the description. The description of the exemplary embodiments of the present disclosure made below with reference to the accompanying drawings is intended to interpret the general inventive concept of the present disclosure, rather than being construed as limiting the present disclosure.

In addition, in the following detailed description, for the convenience of description, numerous specific details are set forth for providing a full understanding of the embodiments of the present disclosure. Obviously, however, one or more embodiments may be implemented without those specific details. In other cases, the well-known structures and devices are shown schematically to simplify the accompanying drawings.

Embodiments of the present disclosure provide a light distribution member, which can be used, for example, as a lighting and/or signaling device of a motor vehicle, such as a high mount stop lamp, a turn signal lamp or a position lamp. The light distribution member can modulate light emitted from a light source and entering the light distribution member via a light incidence surface or light inlet of the light distribution member, in particular via a single one light incidence surface or light inlet, so as to form an emergent light having a desired light distribution or pattern emerging from the light emergence surface, thereby achieving a lighting and/or signaling function. A reflective structure is formed on a side surface of the light distribution member to reflect at least a portion of the light entering the light distribution member toward the light emergence surface such that the portion of the light exits from the light emergence surface at a predetermined angle relative to a longitudinal direction of the vehicle, to meet the external visibility of a certain angle range, ensuring that nearby traffic participants can view the vehicle equipped with the light distribution member when located within a certain angle range (at a side position), thereby improving driving safety.

In an exemplary embodiment, as shown in FIG. 1, the light distribution member 1000 comprises a main body part 1100. The main body part 1100 includes or defines a light incidence surface 1200, a light emergence surface 1300, and a first side surface 1110 and a second side surface 1120 configured as reflective faces. Here, the main body part 1100 includes a single light incidence surface. An axis O-O' of the light distribution member 1000, which corresponds to a main exit direction of the light distribution member or a longitudinal direction of the vehicle, is also shown. A light source for the light distribution member may be arranged on the axis.

As shown, the light distribution member 1000 or its main body part 1100 has a generally plate-like fan-shaped profile as a whole. Here, the light emergence surface 1300 and the light incidence surface 1200 may be arranged sequentially in a first direction Y parallel to the axis O-O', and the first side surface 1110 and the second side surface 1120 are located on either side of the main body part 1100 in a second direction X perpendicular to the axis O-O'. In other words, two quadrants may be divided and formed by the first direction Y and the second direction X, where the axis O-O' is the boundary between the two quadrants, the first side surface 1110 is in the second quadrant and the second side surface 1120 is in the first quadrant. Here, the first side surface 1110 and the second side surface 1120 may be connected or jointed to the light incidence surface 1200, respectively. The light distribution member 1000 or its main body part 1100 also has a thickness extending in a third direction Z perpendicular to the first direction Y and second direction X. In one example, the thickness is constant, for example about 10 mm, but the present disclosure is not limited to this, and the thickness may be selected or designed according to the specific application and requirements of the light distribution member.

Light from the light source 1001 enters the main body part 1100 through the light incidence surface 1200. The light incidence surface 1200 is, for example, a face formed or defined by a recess or notch of the main body part 1100 facing the light source 1001, as shown in FIGS. 1, 3, 4, 5, 7 and 8. The light distribution member 1000 adjusts or orients the light entering the main body part 1100 from the light source 1001 via the light incidence surface 1200, so as to collimate the light at least at the light incidence surface in the thickness direction of the light distribution member, such that a portion of the light that is adjusted or oriented by the light incidence surface 1200 acts as a substantially parallel first light beam 1002 traveling directly in the main body part 1100 toward the light emergence surface 1300. For ease of understanding, "parallel" herein is explained with reference to the axis O-O', for example, it refers to "parallel to the axis", the "parallel" mentioned below can also be understood as such. Of course, the adjusted first light beam 1002 may also have a certain angle relative to the axis O-O'.

It will be understood that the light source described herein is not limited to a light emitting element, for example, an LED, but may also be an optical element that converges or otherwise modulates light from a light emitting element, for example, a condenser or lens, etc. Accordingly, a light emitting point of the light source described herein may be a center of the light emitting element, or a light emitting center of the optical element.

Figure 2:
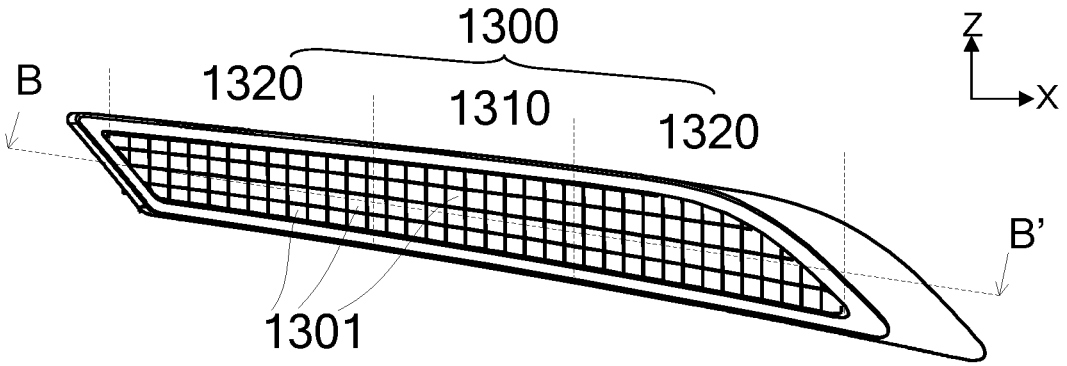
FIG. 2 is a front perspective view of a light distribution member according to an exemplary embodiment of the present disclosure, showing the structure of a light emergence surface when viewed in a direction opposite to a light emergence direction of the light distribution member.

In an embodiment, as shown in FIG. 2, the light emergence surface 1300 is formed with or is provided with a light distribution structure, for example, an array structure of dome shaped or pillow shaped protrusions 1301, so as to form uniform emergent light and to enable the emergent light to satisfy regulatory requirements for light emergence angle in relevant countries or regions. It is understood that the shape, structure, arrangement, etc. of the light emergence surface 1300 or its protrusions 1301 may be designed by those skilled in the art according to the needs or relevant regulations.

Figure 3:
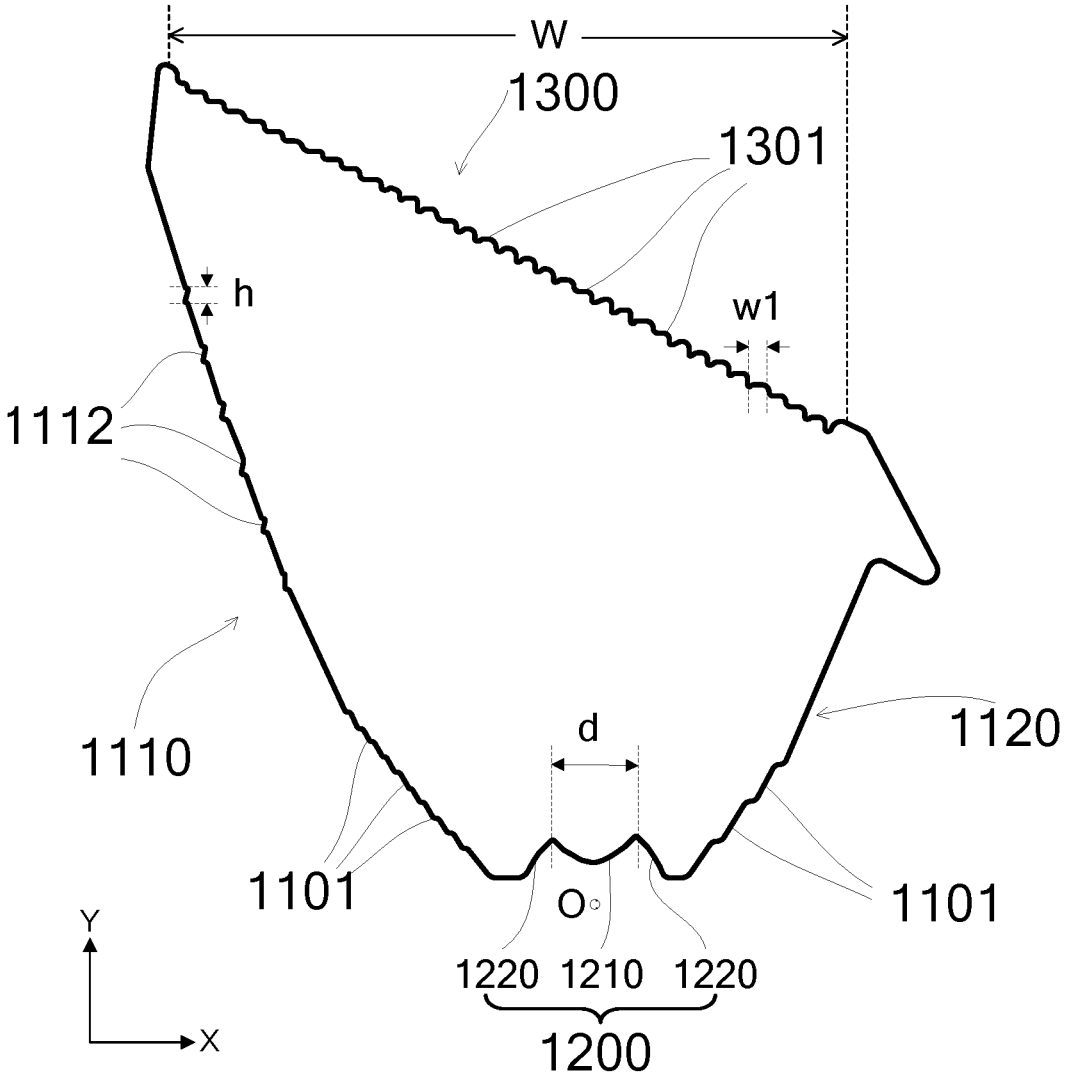
FIG. 3 is a cross sectional view taken along the line B-B' in FIG. 2, showing a structure of a light distribution member according to an exemplary embodiment of the present disclosure.

As shown in FIG. 3, the light emergence surface 1300 has a width W extending in the second direction X. A single dome shaped or pillow shaped protrusion 1301 has a width w1 extending in the second direction X, wherein the widths w1 of the respective protrusions 1301 may be the same as or different from each other. In some examples, the width W is at least 60 mm, for example up to 94.7 mm, and the corresponding width w1 is about 2.7 mm, but the present disclosure is not limited thereto, and these widths may be selected or designed according to the specific application and requirements of the light distribution member.

The light emergence surface 1300 may be at any suitable angle with respect to the axis O-O' as required.

According to an embodiment of the present disclosure, at least one of the first side surface 1110 and the second side surface 1120 of the light distribution member 1000 is provided with a first reflective structure 1112, which is configured to cause another portion of the light entering the main body part 1100 to travel in the main body part 1100 at a first reflective interface between the first reflective structure 1112 and the air outside the light distribution member toward the light emergence surface 1300, to exit as a second light beam 1003 at the light emergence surface 1300, wherein the emergent light is at an angle $\alpha$ relative to the axis O-O', for example 80±5 degrees, so as to form externally visible light and to meet regulatory requirements for the external visibility of a lighting or signaling device such as a turn signal lamp or position lamp, as shown in FIGS. 1, 3-6.

In addition, although in the illustrated embodiments, only the first side surface 1110 of the light distribution member 1000 is provided with the first reflective structure 1112, it can be understood that in other embodiments, the second side surface 1120 may also be provided with such a reflective structure as required, so that it allows to achieve the external visibility on opposite sides of the light distribution member, thereby further improving the driving safety. The following description is only made by taking the first side surface 1110 with the first reflective structure 1112 as an example.

In one example, the first reflective structure 1112 is a totally-reflective surface to totally reflect, at an interface between the reflective structure and the outside air, light traveling in the main body part 1100 to the interface, avoiding the emission of light from a side surface. In this way, the reflected light travels in the main body part 1100 toward the light emergence surface 1300.

In some exemplary embodiments, as shown in FIGS. 1, 3-5, the first reflective structures 1112 are arranged and spaced apart from each other at a predetermined spacing along the first side surface 1110, and each first reflective structure 1112 is tilted at a corresponding angle relative to the axis O-O', thereby causing the light reflected at the first reflective interface between the first reflective structure 1112 and the outside air and exiting from the light emergence surface 1300 is at an angle within a predetermined angle range relative to the axis O-O', for example 80±5 degrees. In this way, it allows to meet regulatory requirements and to ensure that nearby traffic participants (such as pedestrians or other vehicle drivers) are able to see the vehicle equipped with the light distribution member when located within a certain angle range, for example, at a side position with respect to the vehicle, thereby improving driving safety. It can be understood that the first reflective structures 1112 may also be connected or combined with each other as long as the reflective surfaces can be used to achieve emergent light for external visibility within a certain angle range.

Figure 5:
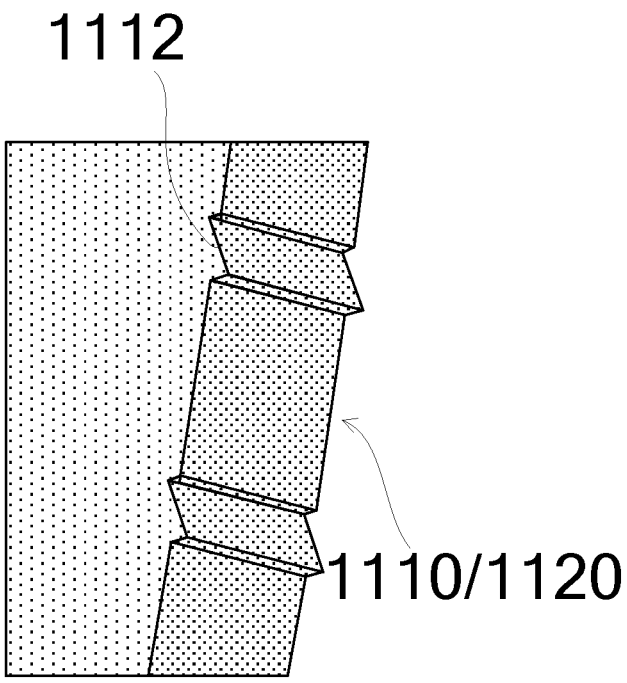
FIG. 5 is a partial enlarged view of the dotted circle portion shown in FIG. 4, schematically showing an exemplary structure of the light distribution member for implementing external visibility according to an embodiment of the present disclosure.
Figure 6:
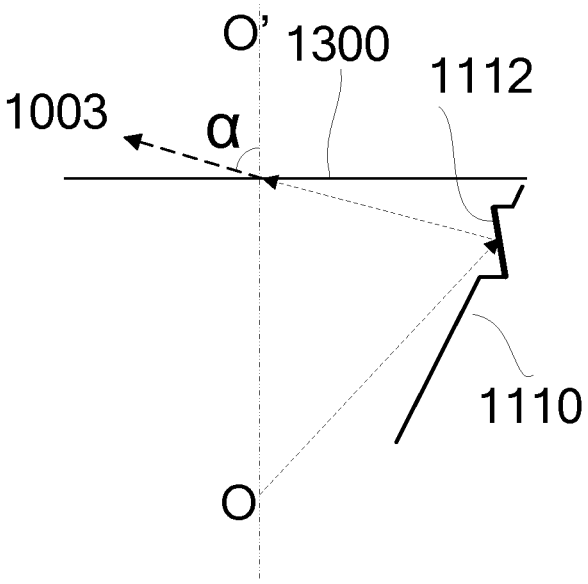
FIG. 6 is a schematic view showing light paths for external visibility of a light distribution member according to an embodiment of the present disclosure.

As shown in FIGS. 5 and 6, in the second side surface, at least one first reflective structure 1112 is tilted toward the axis O-O' (for example, in the Figures, it gradually approaches the axis O-O' from the bottom to the top) to extend to the light emergence surface 1300. The angles of respective first reflective structures 1112 titled with respect to the axis O-O' and/or material and shape of the light distribution member can be set or designed according to actual requirements, so that they could achieve modulation or redistribution of light through reflection (e.g., total reflection) or other re-orienting means, so as to ensure that emergent light that could be used for achieving external visibility within a certain angle range can be obtained by means of these reflective surfaces.

As shown in FIG. 3, each first reflective structure 1112 has a dimension h extending in the first direction Y, and the dimensions h of the respective first reflective structures 1112 may be the same as or different from each other. In one example, the dimension h is approximately 2 mm, but the present disclosure is not limited to this, and this dimension may be selected or designed according to the specific application and requirements of the light distribution member.

In some embodiments, as shown in FIGS. 1-3, the light incidence surface 1200 includes or defines a first light incidence sub-surface 1210 and second light incidence sub-surfaces 1220 located on either side of the first light incidence sub-surface 1210 (in the second direction X). The light emergence surface 1300 includes or defines a first light emergence sub-region 1310 and second light emergence sub-regions 1320 located on either side of the first light emergence sub-region 1310 (in the second direction X). It is understood that, although for convenience of description, different regions of the light incidence surface and light emergence surface may be described in different expressions herein, but these regions may be continuous or integral with each other, or may be spaced apart from each other.

As shown, the first light incidence sub-surface 1210 is an intermediate portion of the light incidence surface 1200 that at least substantially collimates light entering the main body part 1100 through the first light incidence sub-surface 1210 into parallel light, for example parallel light parallel to the axis O-O', and the parallel light travels in the main body part 1100 to the first light emergence sub-region 1310 and exits from first light emergence sub-region 1310.

Figure 4:
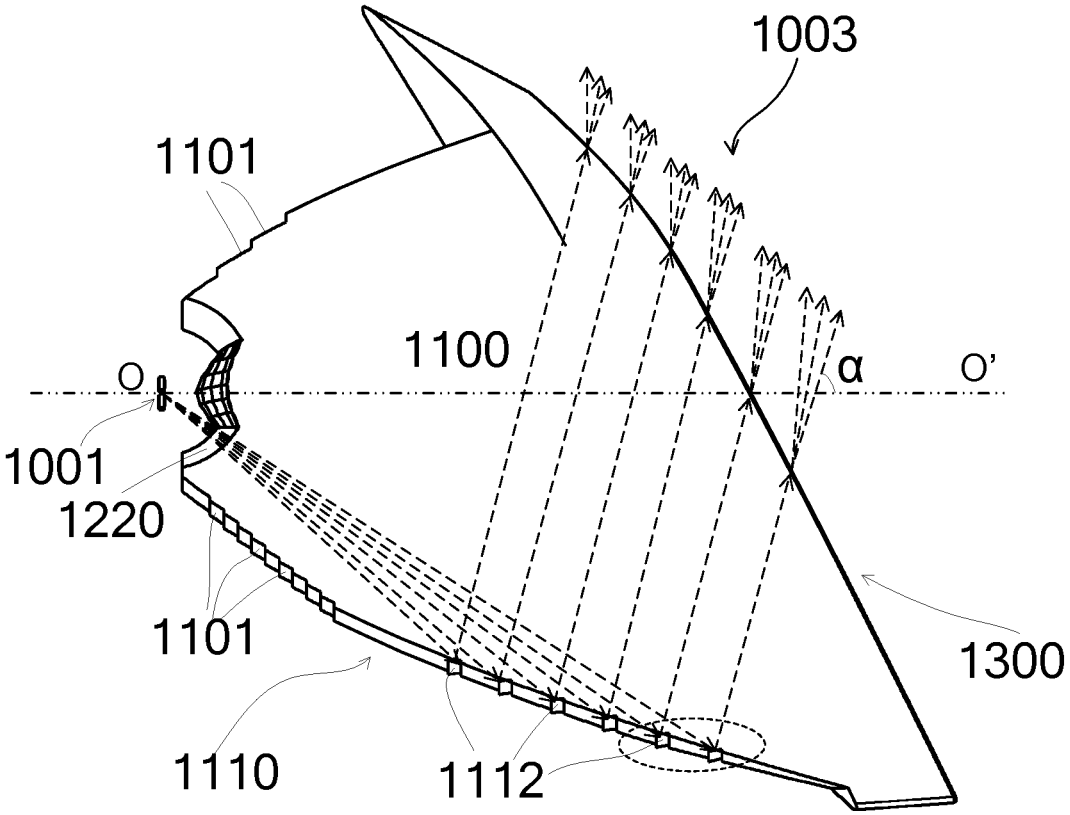
FIG. 4 is a side perspective view of a light distribution member according to an exemplary embodiment of the present disclosure, in which only light paths for external visibility are shown schematically and separately.
Figure 7:
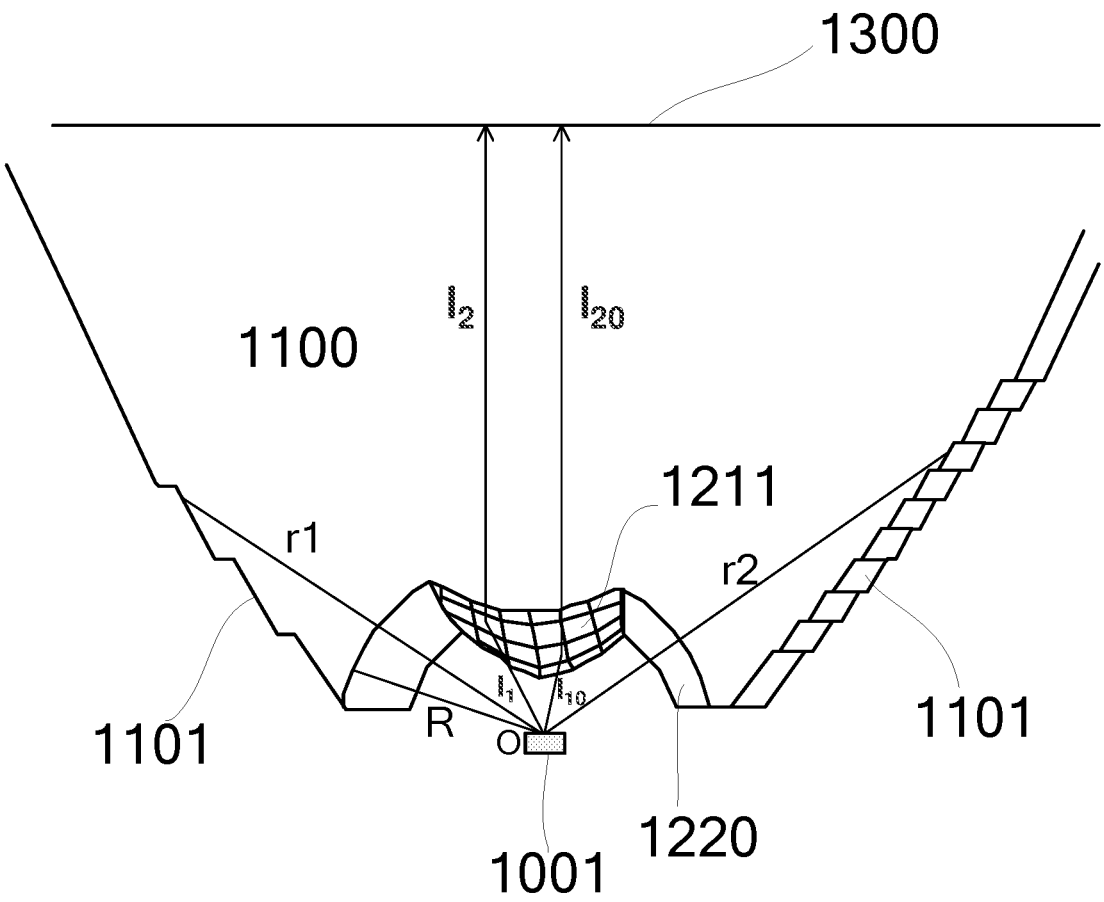
FIG. 7 is a rear perspective view schematically showing a structure of a light distribution member according to an exemplary embodiment of the present disclosure.

In some examples, as shown in FIGS. 1, 4 and 7, the first light incidence sub-surface 1210 is provided or formed with an array structure of a plurality of dome shaped or pillow shaped protrusions 1211, which are configured to collimate a portion of light (e.g., cone-shaped light) from the light source 1001 into parallel light that travels in the main body part 1100 directly toward the light emergence surface 1300. For example, respective protrusions 1211 protrude toward the light source 1001 at different angles or orientations, a distance from a center of the protrusion 1211 to the light emitting point O of the light source 1001 varies, such that the overall contour of the first light incidence sub-surface 1210 appears as a dome shape that protrudes toward the light source 1001. As shown in FIG. 3, the cross section of the first light incidence sub-surface 1210 has a dimension d extending in the second direction X. In one example, the dimension d is approximately 18 mm.

Exemplarily, assuming that a distance or light path length from the light source 1001 to a position on the first light incidence sub-surface 1210 or on the protrusion 1211 is $I_1$ (air exists between the light source 1001 and the first light incidence sub-surface 1210), a vertical distance or light path length from the position to the light emergence surface 1300 is $I_2$; a distance or light path length from the light source 1001 to another position on the first light incidence sub-surface 1210 or on the protrusion 1211 is $I_{10}$, a vertical distance or light path length from the another position to the light emergence surface 1300 is $I_{20}$, and the refractive index of the light distribution member or its main body part 1100 is n, then the shape or position of each dome shaped or pillow shaped protrusion 1211 of the first light incidence sub-surface 1210 can satisfy the formula: $I_2 \times n + I_1 = I_{20} \times n + I_{10}$.

The second light incidence sub-surface 1220 collimates light from the light source 1001 in the Z direction and causes light, which is transmitted through the second light incidence sub-surface into the main body part 1100, to travel in the main body part 1100 to a corresponding one of the first side surface 1110 and the second side surface 1120. For example; part or all of the light entering the main body part 1100 from the second light incidence sub-surface 1220 on the left side of the figure will travel toward the first side surface 1110 on the left side, while part or all of the light entering the main body part 1100 from the second light incidence sub-surface 1220 on the right side of the figure will travel toward the second side surface 1120 on the right side, and the light is reflected in the main body part 1100 towards the corresponding light emergence region at a reflective interface between the corresponding side surface and the outside air and exits from the light emergence region.

Thus, not only the light from the light source can be emitted from the first light emergence sub-region 1310, as the intermediate region, of the light emergence surface 1300, but also the light which enters the main body part 1100 but deviates from the axis O-O' can be modulated or re-oriented by means of the reflection on the side surface to exit light from the second light emergence sub-regions 1320 on either side of the first light emergence sub-region 1310, which increases the effective light emergence width or area of the light emergence surface 1300, thereby improving optical efficiency of the light distribution member. In some examples of the present disclosure, the effective light emergence width of the light emergence surface 1300 in the second direction X is at least 60 mm, for example up to 94.7 mm, thereby a relatively wide range of light output can be achieved in case that only one single light incidence surface or light inlet is provided in the light distribution member.

In some examples, at least one of the two second light incidence sub-surfaces 1220 has two edge profiles, which are parts of an arc line centered at the light source 1001, in the Z direction. The second light incidence sub-surfaces are also an arched surface protruding toward the light source, so that the light from the light source 1001 can be collimated in the Z direction via the second light incidence sub-surface to enter the main body part 1100. An intersection line between the second light incidence sub-surface and the first light incidence sub-surface is an arc line that protrudes toward the light source.

At least one of the first side surface 1110 and the second side surface 1120 is provided with at least one second reflective structure or similar light redirecting structure. For example, as shown in FIGS. 1, 3, 4 and 7-8, the first side surface 1110 is provided or formed with a second reflective structure 1101. A second reflective interface is formed between the second reflective structure 1101 and the outside air, and the light entering the main body part 1100 via the second light incidence sub-surface 1220 and traveling to the second reflective structure is reflected at the second reflective interface. The reflected light has a travelling direction in which it travels toward the second light emergence sub-region 1320 in the main body part 1100, the travelling direction is at least substantially parallel to the travelling direction of the light entering the main body part 1100 after being collimated by the first light incidence sub-surface, and the reflected light finally exits from the corresponding second light emergence sub-region. Here, the light beam formed by the reflected light also has a certain angle with respect to the axis O-O'.

Referring again to FIG. 6, it can be seen that in the side surface provided with both the first reflective structure 1112 and the second reflective structure 1101, the tilting conditions of the first reflective structure 1112 and the second reflective structure 1101 relative to the axis O-O' of the light distribution member 1000 are different, thereby the light reaching the respective reflective structures can be reflected towards the light emergence surface at different angles.

In the illustrated embodiment, a plurality of second reflective structures 1101 are arranged and spaced apart from each other on the first side surface 1110. Additionally, a plurality of second reflective structures 1101 are arranged and spaced apart from each other on the second side surface 1120. There may be a first reflective structure 1112 or other connection structure between the adjacent second reflective structures 1101. Here, each second reflective structure 1101 may be a part of a paraboloid with a focus point at the light source 1001, for example, a part of a paraboloid formed by sweeping a parabola having a focus point at the light source. Especially in the case where the second reflective structures are misaligned in the X direction, parameters of the paraboloids forming the respective second reflective structures are different from each other. Exemplarily, distances (that is, focus point chord lengths) from centers of the paraboloids where respective second reflective structures 1101 are located to the light source as the focus point are 32 mm, 31 mm, 30 mm, 29 mm, 28 mm and so on in order (that is, in an order from the second reflective structure farthest away from the light source to the second reflective structure that is getting closer to the light source), and this may be selected or designed according to the specific application and requirements of the light distribution member.

As shown in FIGS. 1 and 4, a portion of the light entering the main body part 1100 via the second light incidence sub-surface 1220 travels to the first reflective structure 1112 disposed or formed on the first side surface 1110, and is reflected at an interface between the first reflective structure 1112 and the outside air to travel in the main body part 1100 towards the light emergence surface 1300, achieving the emergent light for external visibility.

It will be appreciated that in some cases, a portion of the light entering the main body part 1100 via the first light incidence sub-surface 1210 may also travel to the first side surface 1110 and/or the second side surface 1120 and be reflected toward the light emergence surface 1300 at different angles by the reflective structure formed on the side surface, thereby further improving the optical efficiency.

Figure 8:
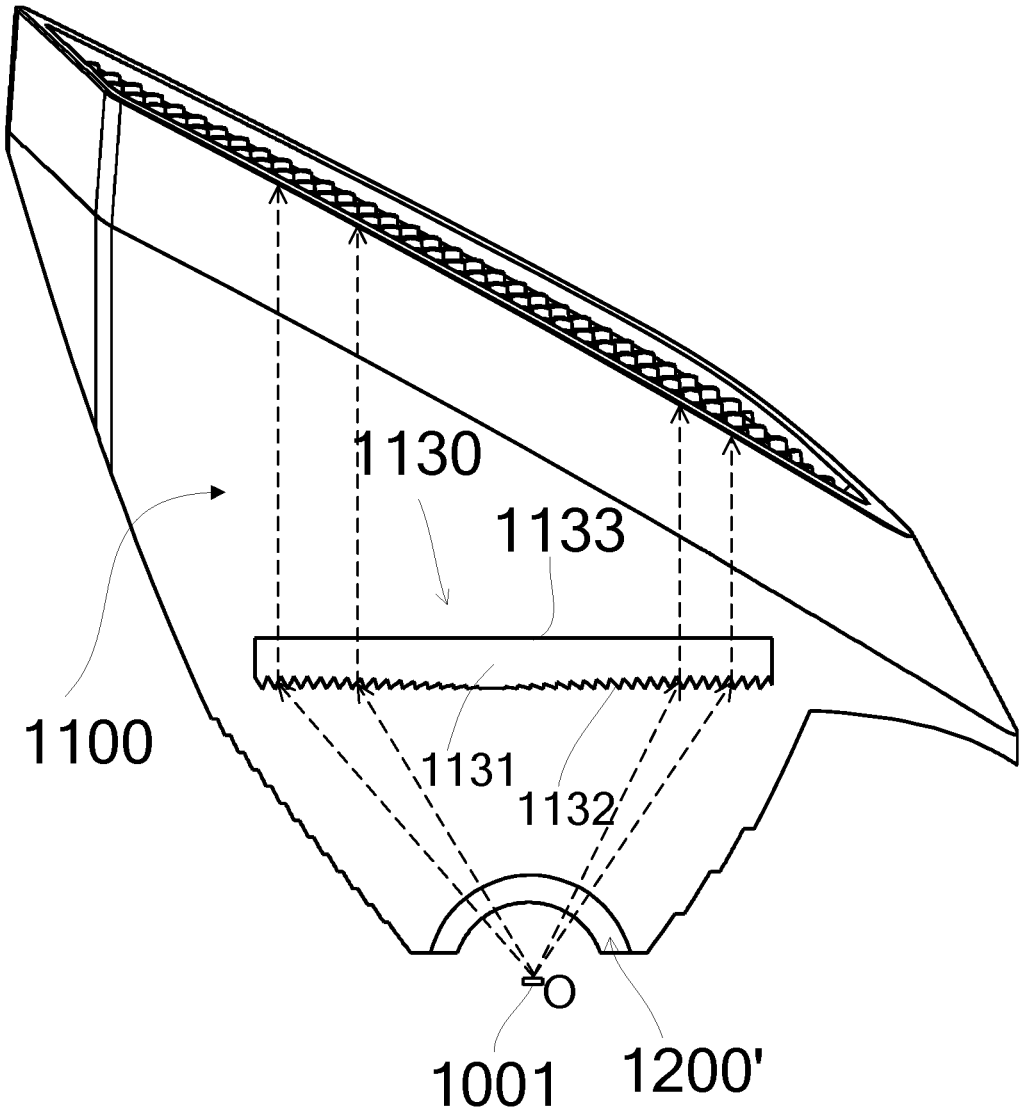
FIG. 8 is a perspective view showing a structure of a light distribution member according to another exemplary embodiment of the present disclosure.

In some other embodiments of the present disclosure, as shown in FIG. 8, the light incidence surface 1200' of the light distribution member has a Fresnel structure, for example a cylindrical Fresnel structure, and the light source 1001 is located at the center of the Fresnel structure. In this case, the light from light source 1001 enters the main body part 1100 at respective positions of the light incidence surface 1200' after being collimated via the cylindrical Fresnel structure in the Z direction, that is, in the thickness direction of the light distribution member. In this case, more reflective faces or similar light re-orienting structures may be provided or formed on one or more side surfaces of the light distribution member to reflect light, which comes from the light source 1001 and enters the main body part 1100 via the light incidence surface 12000' having a cylindrical Fresnel structure, towards the light emergence surface 1300.

In some embodiments of the present disclosure, as shown in FIG. 8, the main body part 1100 is formed therein with a Fresnel lens structure 1130, which is configured to collimate at least a portion of the light, which enters the main body part 1100 via the light incidence surface, in the second direction X into parallel light parallel to the axis O-O', thereby achieving more uniform light emergence. For example, the Fresnel lens structure 1130 is a linear Fresnel lens extending in the second direction X. In FIG. 8, the Fresnel lens structure 1130 is formed or defined by a through hole 1131 (for example, a rectangular hole) formed in the main body part 1100. The through hole 1131 penetrates through the main body part 1100 in the third direction Z, and a side wall of the through hole 1131 (e.g., a side wall close to the light source) may be formed with a plurality of jagged light distribution portions 1132 for collimating the light into parallel light. The opposite side walls of the through hole 1131 (e.g., the side walls near the light emergence surface) may be flat perpendicular to the exiting direction of the parallel light formed by the light distribution portions 1132.

In the above embodiments, the adjusted or oriented parallel light and the light reflected by the first reflective structure, after reaching the light emergence surface 1300, exit from the light emitting surface having the light distribution function to form a light distribution that meets the regulatory requirements.

It should be noted that although it is shown in the figures that the light emergence surface of the light distribution member is tilted relative to the axis, this is only illustrative. Orientation of the light emergence surface of the light distribution member may be set as required, and the light distribution structure that forms the light emergence surface should be adjusted accordingly.

The light distribution member provided by the embodiments of the present disclosure may be applied to various lighting or signaling devices. The lighting or signaling device may include a light source 1001 and the above light distribution member, and the light from the light source may be modulated or distributed by the light distribution member to achieve normal light emergence and external visibility. Exemplarily, the lighting or signaling device may include one of a turn signal lamp or a position lamp of a motor vehicle.

An embodiment of the present disclosure also provides a motor vehicle that includes the lighting or signaling device described in any of the above embodiments.

Although the present disclosure has been described in conjunction with the accompanying drawings, the embodiments disclosed in the drawings are intended to exemplify preferred implementations of the present disclosure, and are not to be construed as a limitation on the present disclosure. The sizes and scales in the drawings are merely illustrative and should not be construed as a limitation on the present disclosure.

Although some of the embodiments of the present disclosure have been shown and described, those of ordinary skill in the art will appreciate that changes can be made to these embodiments without departing from the principle and spirit of the general inventive concept of the present disclosure. The scope of the present disclosure is defined by the claims and their equivalents.

What is claimed:

1. A light distribution member for a motor vehicle, the light distribution member having an axis (O-O') and comprising a main body part, the main body part defining:

a light incidence surface, through which light from a light source enters the main body part;

a light emergence surface, a portion of the light entering the main body part being allowed to reach the light emergence surface directly in such a way that the portion of the light acts as a first light beam that is at least substantially parallel; and a first side surface and a second side surface, the first side surface and second side surface being reflective faces and arranged on either side of the axis (O-O'), wherein at least one of the first side surface and the second side surface is provided with at least one first reflective structure configured to reflect the light reaching it, and to direct the reflected light as a second light beam toward the light emergence surface, and wherein an angle of the first light beam relative to the axis (O-O') is different from an angle of the second light beam relative to the axis (O-O').

2. The light distribution member according to claim 1, wherein at least one of the first side surface and the second side surface is further provided with at least one second reflective structure configured to reflect the light reaching it in such a way that the reflected light is at least substantially parallel to the first light beam.

3. The light distribution member according to claim 2, wherein a plurality of said second reflective structures are provided and arranged adjacently or spaced apart on corresponding side surfaces, and wherein each of the second reflective structures is a part of a paraboloid having a focus point where the light source is located.

4. The light distribution member according to claim 2, wherein the light incidence surface comprises a first light incidence sub-surface and second light incidence sub-surfaces located on either side of the first light incidence sub-surface, the light emergence surface comprises a first light emergence sub-region and second light emergence sub-regions located on either side of the first light emergence sub-region, the first light incidence sub-surface is configured to collimate the light entering the main body part through the first light incidence sub-surface into a parallel light such that the parallel light travels in the main body part, parallelly to the axis (O-O'), to the first light emergence sub-region, and exits from the first light emergence sub-region, and each of the second light incidence sub-surfaces is configured to cause light, which is transmitted through the second light incidence sub-surface into the main body part, to travel in the main body part to a corresponding side surface of the first side surface and the second side surface and to be reflected in the main body part toward the light emergence surface at the corresponding side surface.

5. The light distribution member according to claim 2, wherein the light incidence surface is a cylindrical Fresnel lens structure centered at the light source.

6. A lighting or signaling device, comprising a light source and the light distribution member according to claim 2.

7. The light distribution member according to claim 1, wherein a plurality of said first reflective structures are provided and distributed on at least one of the first side surface and the second side surface, and are tilted at corresponding angles relative to the axis (O-O').

8. The light distribution member according to claim 7, wherein the at least one of said first reflective structures is tilted toward the axis (0-0') in a light emergence direction.

9. The light distribution member according to claim 7, wherein the light incidence surface comprises a first light incidence sub-surface and second light incidence sub-surfaces located on either side of the first light incidence sub-surface, the light emergence surface comprises a first light emergence sub-region and second light emergence sub-regions located on either side of the first light emergence sub-region, the first light incidence sub-surface is configured to collimate the light entering the main body part through the first light incidence sub-surface into a parallel light such that the parallel light travels in the main body part, parallelly to the axis (O-O'), to the first light emergence sub-region, and exits from the first light emergence sub-region, and each of the second light incidence sub-surfaces is configured to cause light, which is transmitted through the second light incidence sub-surface into the main body part, to travel in the main body part to a corresponding side surface of the first side surface and the second side surface and to be reflected in the main body part toward the light emergence surface at the corresponding side surface.

10. A lighting or signaling device, comprising a light source and the light distribution member according to claim 7.

11. The light distribution member according to claim 1 wherein the light distribution member has a single light incidence surface.

12. The light distribution member according to claim 1, wherein the light incidence surface comprises a first light incidence sub-surface and second light incidence sub-surfaces located on either side of the first light incidence sub-surface, the light emergence surface comprises a first light emergence sub-region and second light emergence sub-regions located on either side of the first light emergence sub-region, the first light incidence sub-surface is configured to collimate the light entering the main body part through the first light incidence sub-surface into a parallel light such that the parallel light travels in the main body part, parallelly to the axis (O-O'), to the first light emergence sub-region, and exits from the first light emergence sub-region, and each of the second light incidence sub-surfaces is configured to cause light, which is transmitted through the second light incidence sub-surface into the main body part, to travel in the main body part to a corresponding side surface of the first side surface and the second side surface and to be reflected in the main body part toward the light emergence surface at the corresponding side surface.

13. The light distribution member according to claim 12, wherein the first light incidence sub-surface is provided with a plurality of dome shaped or pillow shaped protrusions configured to cooperate with each other to collimate the light, which enters the main body pali through the protrusions, into the parallel light.

14. The light distribution member according to claim 12, wherein at least one of the second light incidence sub-surfaces is an arched surface, which is configured to collimate light in a thickness direction of the light distribution member.

15. The light distribution member according to claim 14, wherein an edge profile of the at least one of the second light incidence sub-surfaces in the thickness direction of the light distribution member is a part of a circular arc line having a center where the light source is located.

16. The light distribution member according to claim 15, wherein the main body part is formed therein with a linear Fresnel lens structure.

17. The light distribution member according to claim 1, wherein the light incidence surface is a cylindrical Fresnel lens structure centered at the light source.

18. A lighting or signaling device, comprising a light source and the light distribution member according to claim 1.

19. The lighting or signaling device according to claim 18, wherein the lighting or signaling device comprises one of a turn signal lamp or a position lamp of a motor vehicle.

20. A motor vehicle comprising the lighting or signaling device according to claim 18.

* * * * *